US010954721B2

(12) United States Patent
Russell et al.

(10) Patent No.: US 10,954,721 B2
(45) Date of Patent: Mar. 23, 2021

(54) EARTH-BORING TOOLS AND RELATED METHODS

(71) Applicant: Baker Hughes Holdings LLC, Houston, TX (US)

(72) Inventors: Steven Craig Russell, Sugar Land, TX (US); Stephen Duffy, Spring, TX (US)

(73) Assignee: Baker Hughes Holdings LLC, Houston, TX (US)

( * ) Notice: Subject to any disclaimer, the term of this patent is extended or adjusted under 35 U.S.C. 154(b) by 377 days.

(21) Appl. No.: 16/004,765

(22) Filed: Jun. 11, 2018

(65) Prior Publication Data

US 2019/0376345 A1 Dec. 12, 2019

(51) Int. Cl.

| | |
|---|---|
| ***E21B 10/42*** | (2006.01) |
| ***E21B 10/54*** | (2006.01) |
| ***E21B 10/567*** | (2006.01) |
| ***E21B 10/43*** | (2006.01) |
| ***E21B 10/55*** | (2006.01) |
| *E21B 7/06* | (2006.01) |

(52) U.S. Cl.

CPC ..... *E21B 10/5673* (2013.01); *E21B 10/43* (2013.01); *E21B 10/55* (2013.01); *E21B 7/064* (2013.01)

(58) Field of Classification Search

CPC ..... E21B 10/43; E21B 10/55; E21B 10/5673; E21B 7/064; E21B 10/14; E21B 10/42; E21B 10/567; E21B 2010/425; E21B 2010/545

See application file for complete search history.

(56) References Cited

U.S. PATENT DOCUMENTS

| | | | |
|---|---|---|---|
| 3,153,458 | A | 10/1964 | Short |
| 3,709,308 | A | 1/1973 | Rowley et al. |
| 4,058,177 | A | 11/1977 | Langford, Jr. et al. |

(Continued)

FOREIGN PATENT DOCUMENTS

| | | | |
|---|---|---|---|
| EP | 1190791 | A2 | 3/2002 |
| EP | 1116858 | B1 | 7/2011 |
| WO | 2016/153499 | A1 | 9/2016 |

OTHER PUBLICATIONS

International Search Report for International Application No. PCT/US2019/036387 dated Sep. 30, 2019, 6 pages.

(Continued)

*Primary Examiner* — Daniel P Stephenson
(74) *Attorney, Agent, or Firm* — TraskBritt

(57) ABSTRACT

An earth-boring tool includes a body, at least one blade extending axially from the body, at least one cutting element mounted at a leading face of the at least one blade and at least one hybrid ovoid mounted at an axial end of the at least one blade and rotationally trailing the at least one cutting element. The at least one hybrid ovoid includes a cylindrical base portion, a domed upper portion extending from a top of the cylindrical base portion, and an at least substantially planar cutting surface formed in at least the domed upper portion and defining a cutting edge extending angularly through an angle of at least 180°, the at least substantially planar cutting surface is configured for a shear-type cutting action, oriented substantially in the direction of intended bit rotation, and exhibits a lesser aggressiveness than the aggressiveness of the at least one cutting element.

21 Claims, 10 Drawing Sheets

(56) References Cited

U.S. PATENT DOCUMENTS

| | | | | |
|---|---|---|---|---|
| 4,351,401 | A | 9/1982 | Fielder | |
| 4,554,986 | A | 11/1985 | Jones | |
| 4,722,405 | A | 2/1988 | Langford, Jr. | |
| 4,889,017 | A | 12/1989 | Fuller et al. | |
| 4,982,802 | A | 1/1991 | Warren et al. | |
| 4,991,670 | A | 2/1991 | Fuller et al. | |
| 5,010,789 | A | 4/1991 | Brett et al. | |
| 5,042,596 | A | 8/1991 | Brett et al. | |
| 5,111,892 | A | 5/1992 | Sinor et al. | |
| 5,131,478 | A | 7/1992 | Brett et al. | |
| 5,172,777 | A | 12/1992 | Siracki et al. | |
| 5,199,511 | A | 4/1993 | Tibbitts et al. | |
| 5,244,039 | A | 9/1993 | Newton, Jr. et al. | |
| 5,303,785 | A | 4/1994 | Duke | |
| 5,314,033 | A | 5/1994 | Tibbitts | |
| 5,322,138 | A | 6/1994 | Siracki | |
| 5,323,865 | A | 6/1994 | Isbell et al. | |
| 5,402,856 | A | 4/1995 | Warren et al. | |
| 5,551,768 | A | 9/1996 | Fennel et al. | |
| 5,592,995 | A | 1/1997 | Scott et al. | |
| 5,595,252 | A | 1/1997 | O'Hanlon | |
| 5,697,462 | A | 12/1997 | Grimes et al. | |
| 5,706,906 | A | 1/1998 | Jurewicz et al. | |
| 5,746,280 | A * | 5/1998 | Scott | E21B 10/16 175/374 |
| 5,855,247 | A | 1/1999 | Scott et al. | |
| 6,050,354 | A | 4/2000 | Pessier et al. | |
| 6,053,263 | A | 4/2000 | Meiners | |
| 6,059,054 | A | 5/2000 | Portwood et al. | |
| 6,098,730 | A | 8/2000 | Scott et al. | |
| 6,298,930 | B1 | 10/2001 | Sinor et al. | |
| 6,332,503 | B1 | 12/2001 | Pessier et al. | |
| 6,408,958 | B1 | 6/2002 | Isbell et al. | |
| 6,443,248 | B2 | 9/2002 | Yong et al. | |
| 6,460,631 | B2 | 10/2002 | Dykstra et al. | |
| 6,568,492 | B2 | 5/2003 | Thigpen et al. | |
| 6,571,891 | B1 | 6/2003 | Smith et al. | |
| 6,779,613 | B2 | 8/2004 | Dykstra et al. | |
| 6,883,623 | B2 * | 4/2005 | McCormick | E21B 10/46 175/408 |
| 6,935,441 | B2 | 8/2005 | Dykstra et al. | |
| 7,546,888 | B2 * | 6/2009 | Cruz | E21B 10/36 175/415 |
| 7,621,348 | B2 | 11/2009 | Hoffmaster et al. | |
| 7,757,791 | B2 | 7/2010 | Belnap et al. | |
| 7,762,355 | B2 | 7/2010 | McClain et al. | |
| 7,836,979 | B2 | 11/2010 | Green et al. | |
| 8,061,456 | B2 | 11/2011 | Patel et al. | |
| 8,087,478 | B2 | 1/2012 | Patel | |
| 8,240,403 | B2 | 8/2012 | Trinh et al. | |
| 8,448,726 | B2 | 5/2013 | Ganz | |
| 8,459,382 | B2 | 6/2013 | Aliko et al. | |
| 8,505,634 | B2 | 8/2013 | Lyons et al. | |
| 8,584,776 | B2 | 11/2013 | Radford et al. | |
| 8,684,112 | B2 | 4/2014 | DiGiovanni et al. | |
| 8,757,297 | B2 | 6/2014 | Aliko et al. | |
| 8,794,356 | B2 | 8/2014 | Lyons et al. | |
| 8,851,207 | B2 | 10/2014 | Gavia et al. | |
| 9,051,795 | B2 | 6/2015 | Hall et al. | |
| 9,074,433 | B2 | 7/2015 | Hall et al. | |
| 9,074,435 | B2 | 7/2015 | Scott et al. | |
| 9,097,065 | B2 | 8/2015 | Schwefe et al. | |
| 9,133,667 | B2 | 9/2015 | Jones et al. | |
| RE45,748 | E | 10/2015 | Zhang et al. | |
| 9,316,058 | B2 | 4/2016 | Bilen et al. | |
| 9,366,089 | B2 | 6/2016 | Hall et al. | |
| 9,371,699 | B2 | 6/2016 | Richert et al. | |
| 9,708,856 | B2 | 7/2017 | Hall et al. | |
| 9,920,575 | B2 | 3/2018 | Meiners et al. | |
| 9,920,576 | B2 | 3/2018 | Spencer | |
| 10,066,444 | B2 | 9/2018 | Evans et al. | |
| 10,214,968 | B2 | 2/2019 | Evans et al. | |
| 10,392,867 | B2 | 8/2019 | Savage et al. | |
| 10,697,248 | B2 * | 6/2020 | Russell | E21B 10/43 |
| 2006/0278436 | A1 | 12/2006 | Dykstra et al. | |
| 2007/0199739 | A1 | 8/2007 | Schwefe et al. | |
| 2008/0029312 | A1 | 2/2008 | Hall et al. | |
| 2008/0179108 | A1 | 7/2008 | McClain et al. | |
| 2009/0084607 | A1 | 4/2009 | Ernst et al. | |
| 2009/0084608 | A1 * | 4/2009 | McClain | E21B 10/43 175/431 |
| 2009/0159341 | A1 | 6/2009 | Pessier et al. | |
| 2010/0276200 | A1 | 11/2010 | Schwefe et al. | |
| 2011/0155472 | A1 | 6/2011 | Lyons et al. | |
| 2013/0081880 | A1 | 4/2013 | Schwefe et al. | |
| 2013/0228378 | A1 | 9/2013 | Chen et al. | |
| 2013/0270010 | A1 | 10/2013 | Haugvaldstad | |
| 2014/0262511 | A1 | 9/2014 | Bilen | |
| 2014/0262545 | A1 | 9/2014 | Azar et al. | |
| 2015/0129320 | A1 | 5/2015 | Overstreet et al. | |
| 2016/0053547 | A1 | 2/2016 | Samuel et al. | |
| 2017/0159370 | A1 * | 6/2017 | Evans | E21B 10/43 |
| 2019/0100967 | A1 | 4/2019 | Russell et al. | |
| 2019/0376345 | A1 * | 12/2019 | Russell | E21B 10/5673 |

OTHER PUBLICATIONS

International Written Opinion for International Application No. PCT/US2019/036387 dated Sep. 30, 2019, 6 pages.

Russell et al., Earth-Boring Tools and Related Methods, U.S. Appl. No. 15/725,097, Oct. 4, 2017.

* cited by examiner

EARTH-BORING TOOLS AND RELATED METHODS

RELATED APPLICATION

The subject matter of this application is related to the subject matter of U.S. patent application Ser. No. 15/725,097 to Russell et al., filed Oct. 4, 2017, the disclosure of which is incorporated in its entirety by reference herein.

TECHNICAL FIELD

Embodiments disclosed herein relate to earth-boring tools and related methods of drilling. More particularly, embodiments disclosed herein relate to earth-boring tools incorporating structures for modifying aggressiveness of rotary earth-boring tools employing superabrasive cutting elements, and to related methods.

BACKGROUND

Rotary drag bits employing superabrasive cutting elements in the form of polycrystalline diamond compact (PDC) cutting elements have been employed for decades. PDC cutting elements are typically comprised of a disc-shaped diamond "table" formed under high-pressure and high-temperature conditions and bonded to a supporting substrate such as cemented tungsten carbide (WC), although other configurations are known. Bits carrying PDC cutting elements, which for example, may be brazed into pockets in the bit face, pockets in blades extending from the face, or mounted to studs inserted into the bit body, have proven very effective in achieving high rates of penetration (ROP) in drilling subterranean formations exhibiting low to medium compressive strengths. Improvements in the design of hydraulic flow regimes about the face of bits, cutter design, and drilling fluid formulation have reduced prior, notable tendencies of such bits to "ball" by increasing the volume of formation material which may be cut before exceeding the ability of the bit and its associated drilling fluid flow to clear the formation cuttings from the bit face.

Even in view of such improvements, however, PDC cutting elements still suffer from what might simply be termed "overloading" even at low weight-on-bit (WOB) applied to the drill string to which the bit carrying such cutting elements is mounted, especially if aggressive cutting structures are employed. The relationship of torque to WOB may be employed as an indicator of aggressiveness for cutting elements, so the higher the torque to WOB ratio, the more aggressive the bit. The problem of excessive bit aggressiveness is particularly significant in relatively low compressive strength formations where an unduly great depth of cut (DOC) may be achieved at extremely low WOB. The problem may also be aggravated by drill string oscillations, wherein the elasticity of the drill string may cause erratic application of WOB to the drill bit, with consequent overloading.

Another, separate problem involves drilling from a zone or stratum of relatively higher formation compressive strength to a "softer" zone of significantly lower compressive strength, which problem may also occur in so-called "interbedded" formations, wherein stringers of a harder rock, of relatively higher compressive strength, are intermittently dispersed in a softer rock, of relatively lower compressive strength. As a bit drills into the softer formation material without changing the applied WOB (or before the WOB can be reduced by the driller), the penetration of the PDC cutting elements, and thus the resulting torque on the bit (TOB), increase almost instantaneously and by a substantial magnitude. The abruptly higher torque, in turn, may cause damage to the cutting elements and/or the bit body itself. In directional drilling, such a change causes the tool face orientation of the directional assembly (measuring-while-drilling (MWD) or a steering tool) to fluctuate, making it more difficult for the directional driller to follow the planned directional path for the bit. Thus, it may be necessary for the directional driller to back off the bit from the bottom of the borehole to reset or reorient the tool face. In addition, a downhole motor, such as drilling fluid-driven Moineau-type motors commonly employed in directional drilling operations in combination with a steerable bottom-hole assembly, may completely stall under a sudden torque increase. That is, the bit may stop rotating, stopping the drilling operation and again necessitating backing off the bit from the borehole bottom to re-establish drilling fluid flow and motor output. Such interruptions in the drilling of a well can be time consuming and quite costly.

One problem of overloading cutters beyond the cutters' loading capacity before shearing and breaking commonly occurs in the cone region of the bit. The cutters in the cone region are subject to the highest axial and tangential loads compared to other cutters on the bit, and the region typically is geometrically limited in the number of cutters that can be placed to distribute (e.g., carry) the loads. This problem is often referred to as a "core-out." Core-outs often occur with drilling conglomerates that contain hard nodules such as pyrite and chert, as well as drilling through formation transitions of varying rock strength that results in uneven loading of cutters with WOB and TOB fluctuations. Numerous attempts using varying approaches have been made over the years to protect the integrity of diamond cutting elements and their mounting structures and to limit cutter penetration into a formation being drilled. For example, from a period even before the advent of commercial use of PDC cutting elements, U.S. Pat. No. 3,709,308 discloses the use of trailing, round natural diamonds on the bit body to limit the penetration of cubic diamonds employed to cut a formation. U.S. Pat. No. 4,351,401 discloses the use of surface set natural diamonds at or near the gage of the bit as penetration limiters to control the depth-of-cut of PDC cutting elements on the bit face. The following other patents disclose the use of a variety of structures immediately trailing PDC cutting elements (with respect to the intended direction of bit rotation) to protect the cutting elements or their mounting structures: U.S. Pat. Nos. 4,889,017; 4,991,670; 5,244,039 and 5,303,785. U.S. Pat. No. 5,314,033 discloses, inter alia, the use of cooperating positive and negative or neutral back rake cutting elements to limit penetration of the positive rake cutting elements into the formation. Another approach to limiting cutting element penetration is to employ structures or features on the bit body rotationally preceding (rather than trailing) PDC cutting elements, as disclosed in U.S. Pat. Nos. 3,153,458; 4,554,986; 5,199,511 and 5,595,252.

In another context, that of so-called "anti-whirl" drilling structures, it has been asserted in U.S. Pat. No. 5,402,856 that a bearing surface aligned with a resultant radial force generated by an anti-whirl underreamer should be sized so that force per area applied to the borehole sidewall will not exceed the compressive strength of the formation being underreamed. See also U.S. Pat. Nos. 4,982,802; 5,010,789; 5,042,596; 5,111,892 and 5,131,478.

While some of the foregoing patents recognize the desirability to limit cutter penetration, or DOC, or otherwise limit forces applied to a borehole surface, the disclosed approaches are somewhat generalized in nature and fail to accommodate or implement an engineered approach to achieving a target ROP in combination with more stable, predictable bit performance. Furthermore, the disclosed approaches do not provide a bit or method of drilling which is generally tolerant to being axially loaded with an amount of WOB over and in excess what would be optimum for the current rate-of-penetration for the particular formation being drilled and which would not generate high amounts of potentially bit-stopping or bit-damaging torque-on-bit should the bit nonetheless be subjected to such excessive amounts of weight-on-bit.

Various successful solutions to the problem of excessive cutting element penetration are presented in U.S. Pat. Nos. 6,298,930; 6,460,631; 6,779,613 and 6,935,441, the disclosure of each of which is incorporated by reference in its entirety herein. Specifically, U.S. Pat. No. 6,298,930 describes a rotary drag bit including exterior features to control the depth of cut by cutting elements mounted thereon, so as to control the volume of formation material cut per bit rotation as well as the torque experienced by the bit and an associated bottom-hole assembly. These features, also termed depth of cut control (DOCC) features, provide a non-cutting bearing surface or surfaces with sufficient surface area to withstand the axial or longitudinal WOB without exceeding the compressive strength of the formation being drilled and such that the depth of penetration of PDC cutting elements cutting into the formation is controlled. Because the DOCC features are subject to the applied WOB as well as to contact with the abrasive formation and abrasives-laden drilling fluids, the DOCC features may be layered onto the surface of a steel body bit as an appliqué or hard face weld having the material characteristics required for a high load and high abrasion/erosion environment, or include individual, discrete wear resistant elements or inserts set in bearing surfaces cast in the face of a matrix-type bit, as depicted in FIG. 1 of U.S. Pat. No. 6,298,930. The wear resistant inserts or elements may comprise tungsten carbide bricks or discs, diamond grit, diamond film, natural or synthetic diamond (PDC or TSP), or cubic boron nitride.

While the DOCC features are extremely advantageous for limiting a depth of cut while managing a given, relatively stable WOB, a concern when an earth-boring tool moves rapidly between relatively harder and relatively softer formation materials of markedly difference compressive strengths under high WOB is so-called "stick-slip" of the drill string and bottom hole assembly, which occurs when the bit suddenly engages a formation too aggressively, increasing reactive torque to the extent that drill string rotation ceases until the reactive torque is great enough to rotate the drill string again, albeit in an uncontrolled manner. Thus, tool face orientation may be compromised. In addition to stick-slip, when an earth-boring tool moves rapidly between relatively softer and relatively harder formations under high WOB impact damage to PDC cutting elements and, in extreme cases, to the bit itself, may occur. Use of conventional DOCC features on a PDC cutting element-equipped drill bit may, typically, reduce bit aggressiveness on the order of about 20% to about 30% in comparison to the same bit without the DOCC features. As existing DOCC features rely solely upon the surface area of bearing elements to control exposure of PDC cutting elements and bit aggressiveness, such DOCC features may not be sufficiently responsive in terms of aggressiveness reduction to sudden changes in rock compressive strength to avoid stick-slip and impact damage.

The inventors herein have recognized the shortcomings of conventional DOCC techniques in certain subterranean drilling environments and have developed a counterintuitive, novel and unobvious approach to controlling bit aggressiveness that is substantially more responsive to changes in formation compressive strength, such as may occur with interbedded formations, than conventional feature based DOCC techniques.

BRIEF SUMMARY

Embodiments described herein include an earth-boring tool including a body, at least one blade extending axially from the body, at least one cutting element mounted at a leading face of the at least one blade, and at least one hybrid ovoid mounted at an axial end of the at least one blade and rotationally trailing the at least one cutting element. The at least one hybrid ovoid may include a cylindrical base portion; a domed upper portion extending from a top of the cylindrical base portion; and an at least substantially planar cutting surface formed in at least the domed upper portion and defining a cutting edge extending angularly through an angle of at least 180°, the at least substantially planar cutting surface configured for a shear-type cutting action, oriented substantially in the direction of intended bit rotation, and exhibiting a lesser aggressiveness than the aggressiveness of the at least one cutting element.

Embodiments described herein also include a hybrid ovoid including a cylindrical base portion, a domed upper portion extending from a top of the cylindrical base portion, and an at least substantially planar cutting surface formed in the domed upper portion and defining a cutting edge extending angularly through an angle of at least 180°, the at least substantially planar surface configured for a shear-type cutting action, oriented substantially in the direction of intend bit rotation, and exhibiting a lesser aggressiveness than the aggressiveness of the at least one cutting element.

Embodiments described herein further include a method forming an earth-boring tool. The method may include forming a domed upper portion on a cylindrical base portion of a hybrid ovoid, forming a cutting surface in at least the upper portion of the hybrid ovoid, forming the cutting surface to extend angularly through an angle of at least 180°, and mounting the hybrid ovoid to an axial end of a blade of an earth-boring tool such that a center longitudinal axis of the hybrid ovoid is substantially parallel to a center longitudinal axis of the earth-boring tool.

DETAILED DESCRIPTION

Figure 1:
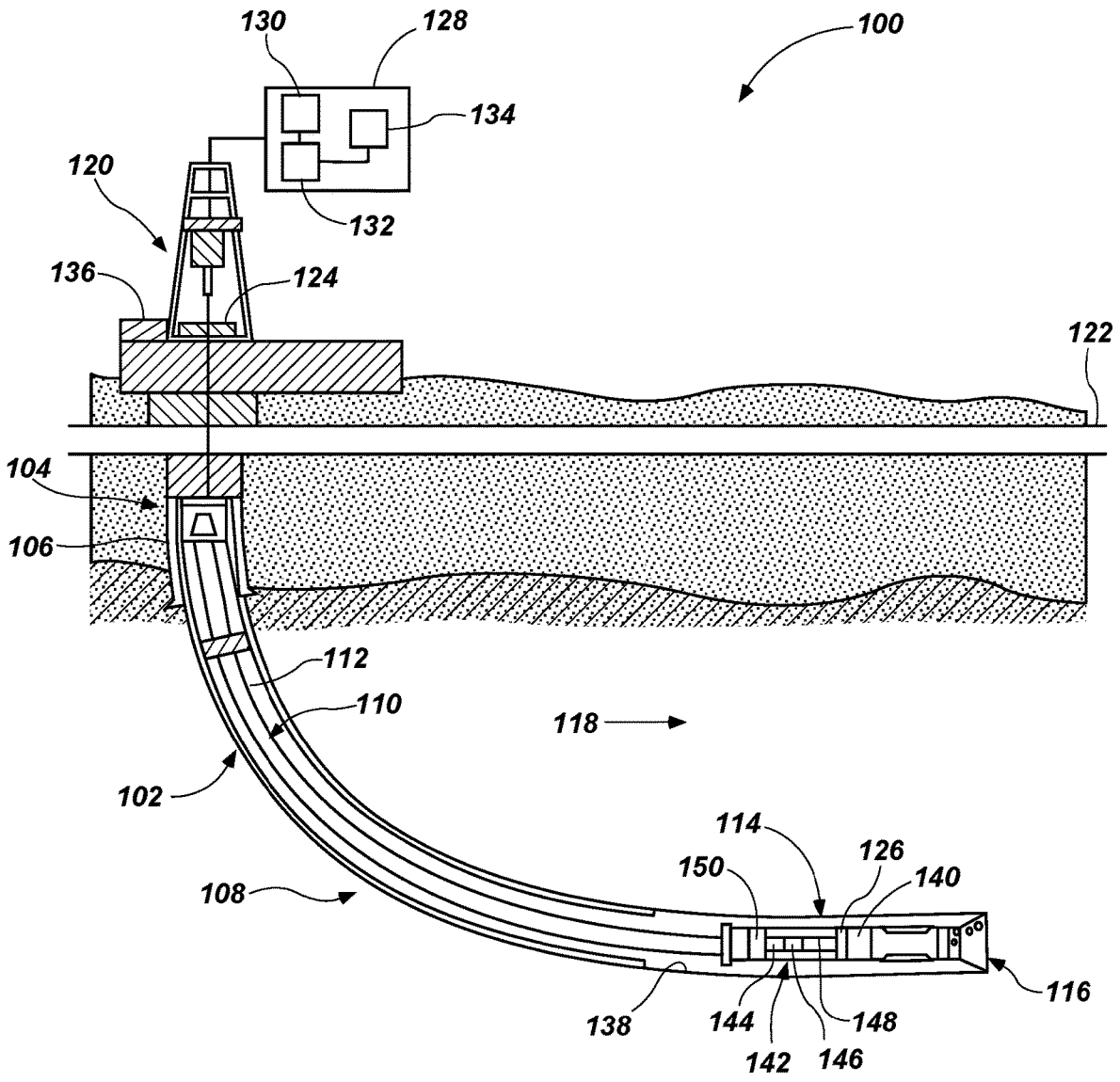
FIG. 1 is a schematic diagram of a wellbore system comprising a drill string that includes an earth-boring tool according to one or more embodiments of the present disclosure.

The illustrations presented herein are not actual views of any drill bit, roller cutter, hybrid ovoid, or any component thereof, but are merely idealized representations, which are employed to describe the present invention.

As used herein, the term "earth-boring tool" includes earth-boring tools for forming, enlarging, or forming and enlarging a borehole. Non-limiting examples of bits include fixed cutter (drag) bits, fixed cutter coring bits, fixed cutter eccentric bits, fixed cutter bi-center bits, fixed cutter reamers, expandable reamers with blades bearing fixed cutters, and hybrid bits including both fixed cutters and rotatable cutting structures (roller cones).

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, the term "cutting structure" means and include any element that is configured for use on an earth-boring tool and for removing formation material from the formation within a wellbore during operation of the earth-boring tool. As non-limiting examples, cutting structures include rotatable cutting structures, commonly referred to in the art as "roller cones" or "rolling cones."

As used herein, the term "cutting elements" means and includes, for example, superabrasive (e.g., polycrystalline diamond compact or "PDC") cutting elements employed as fixed cutting elements, as well as tungsten carbide inserts and superabrasive inserts employed as cutting elements mounted to rotatable cutting structures, such as roller cones. Additionally, in regard to rotatable cutting structures, the term "cutting elements" includes both milled teeth and/or PDC cutting elements. Moreover, the term "cutting elements" includes tungsten carbide inserts.

As used herein, any relational term, such as "first," "second." "top," "bottom," etc., is used for clarity and convenience in understanding the disclosure and accompanying drawings, and does not connote or depend on any specific preference or order, except where the context clearly indicates otherwise. For example, these terms may refer to an orientation of elements of an earth-boring tool when disposed within a borehole in a conventional manner. Furthermore, these terms may refer to an orientation of elements of an earth-boring tool as illustrated in the drawings.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein the term "aggressiveness" when used in reference to a cutting element or hybrid ovoid of a bit or the bit itself means and includes a ratio of TOB to WOB at a specific DOC as measured in inches per bit revolution.

Embodiments of the present disclosure include hybrid ovoids having unique cutting element geometries. In particular, the hybrid ovoid includes a cutting surface formed in a hemispherical upper portion of the hybrid ovoid for efficient and responsive cutting procedures. The hybrid ovoid may include a portion of the hemispherical upper portion for backing of the cutting surface (e.g., as a trailing portion of the hybrid ovoid) for durability. Additionally, the hybrid ovoid may include a relatively long base portion that may be mounted within an axial end of a blade of and earth-boring tool. For instance, the hybrid ovoid may be mounted such that a center longitudinal axis of the hybrid ovoid is parallel to a center longitudinal axis of the earth-boring tool. Accordingly, because the hybrid ovoid is axially mounted, the hybrid ovoid may be mounted in the earth-boring tool in relatively congested areas (e.g., portions) of the earth-boring tool (e.g., proximate a center of the earth-boring tool). Because the hybrid ovoid may be placed proximate to a center (e.g., a cone and/or nose region) of the earth-boring tool, the hybrid ovoid may provide depth-of-cut control and core out protection.

Some embodiments of present disclosure include a hybrid ovoid having a cutting surface defining a cutting edge that extends angularly through an angle of at least 180°. In some instances, the cutting edge may include an at least substantially circular cutting edge. In one or more embodiments, the cutting surface may extend to an apex of the hemispherical upper portion such that crushing loads on the hybrid ovoid are sustained by the rounded surface of the upper portion of the hybrid ovoid. Additionally, the cutting surface of the hybrid ovoid may be configured and oriented for a shear-type cutting action. Moreover, when mounted to an earth-boring tool, the hybrid ovoids may be oriented substantially in the direction of intended bit rotation and may exhibit a lesser aggressiveness than the aggressiveness of at least one cutting element of the earth-boring tool.

FIG. 1 is a schematic diagram of an example of a drilling system 100 that may utilize the apparatuses and methods disclosed herein for drilling boreholes. FIG. 1 shows a borehole 102 that includes an upper section 104 with a casing 106 installed therein and a lower section 108 that is being drilled with a drill string 110. The drill string 110 may include a tubular member 112 that carries a drilling assembly 114 at its bottom end. The tubular member 112 may be made up by joining drill pipe sections or it may be a string of coiled tubing. A drill bit 116 may be attached to the bottom end of the drilling assembly 114 for drilling the borehole 102 of a selected diameter in a formation 118.

The drill string 110 may extend to a rig 120 at surface 122. The rig 120 shown is a land rig 120 for ease of explanation. However, the apparatuses and methods disclosed equally apply when an offshore rig 120 is used for drilling boreholes under water. A rotary table 124 or a top drive may be coupled to the drill string 110 and may be utilized to rotate the drill string 110 and to rotate the drilling assembly 114, and thus the drill bit 116 to drill the borehole 102. A drilling motor 126 may be provided in the drilling assembly 114 to rotate the drill bit 116. The drilling motor 126 may be used alone to rotate the drill bit 116 or to superimpose the rotation of the drill bit 116 by the drill string 110. The rig 120 may also include conventional equipment, such as a mechanism to add additional sections to the tubular member 112 as the borehole 102 is drilled. A surface control unit 128, which may be a computer-based unit, may be placed at the surface 122 for receiving and processing downhole data transmitted by sensors 140 in the drill bit 116 and sensors 140 in the drilling assembly 114, and for controlling selected operations of the various devices and sensors 140 in the drilling assembly 114. The sensors 140 may include one or more of sensors 140 that determine acceleration, weight on bit, torque, pressure, cutting element positions, rate of penetration, inclination, azimuth formation/lithology, etc. In some embodiments, the surface control unit 128 may include a processor 130 and a data storage device 132 (or a computer-readable medium) for storing data, algorithms, and computer programs 134. The data storage device 132 may be any suitable device, including, but not limited to, a read-only memory (ROM), a random-access memory (RAM), a flash memory, a magnetic tape, a hard disk, and an optical disc. During drilling, a drilling fluid from a source 136 thereof may be pumped under pressure through the tubular member 112, which discharges at the bottom of the drill bit 116 and returns to the surface 122 via an annular space (also referred as the "annulus") between the drill string 110 and an inside sidewall 138 of the borehole 102.

The drilling assembly 114 may further include one or more downhole sensors 140 (collectively designated by numeral 140). The sensors 140 may include any number and type of sensors 140, including, but not limited to, sensors generally known as the measurement-while-drilling (MWD) sensors or the logging-while-drilling (LWD) sensors, and sensors 140 that provide information relating to the behavior of the drilling assembly 114, such as drill bit rotation (revolutions per minute or "RPM"), tool face, pressure, vibration, whirl, bending, and stick-slip. The drilling assembly 114 may further include a controller unit 142 that controls the operation of one or more devices and sensors 140 in the drilling assembly 114. For example, the controller unit 142 may be disposed within the drill bit 116 (e.g., within a shank 208 and/or crown 210 of a bit body of the drill bit 116). The controller unit 142 may include, among other things, circuits to process the signals from sensor 140, a processor 144 (such as a microprocessor) to process the digitized signals, a data storage device 146 (such as a solid-state-memory), and a computer program 148. The processor 144 may process the digitized signals, and control downhole devices and sensors 140, and communicate data information with the surface control unit 128 via a two-way telemetry unit 150.

Figure 2:
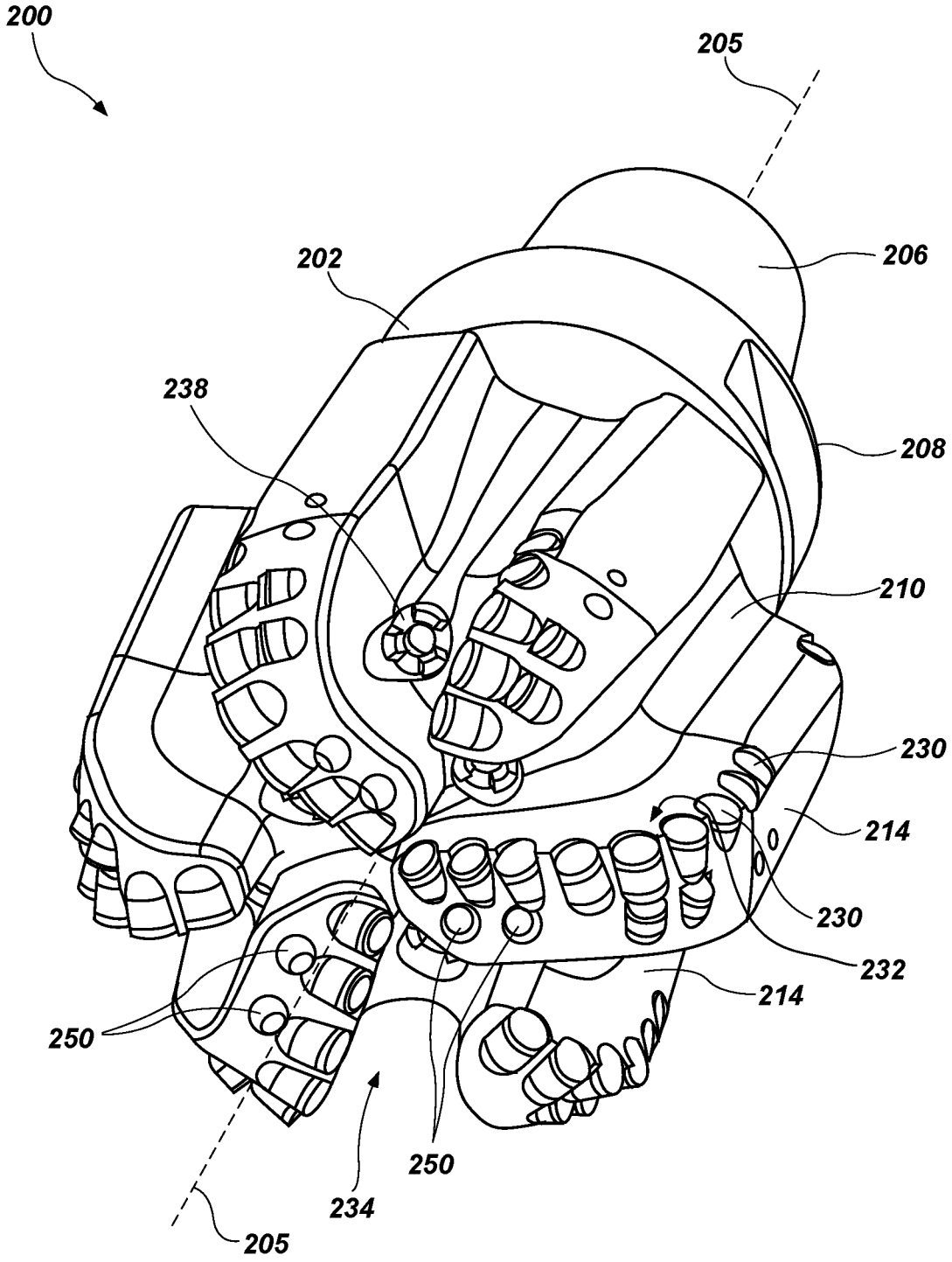
FIG. 2 is a perspective view of an earth-boring tool according to one or more embodiments of the present disclosure.
Figure 3:
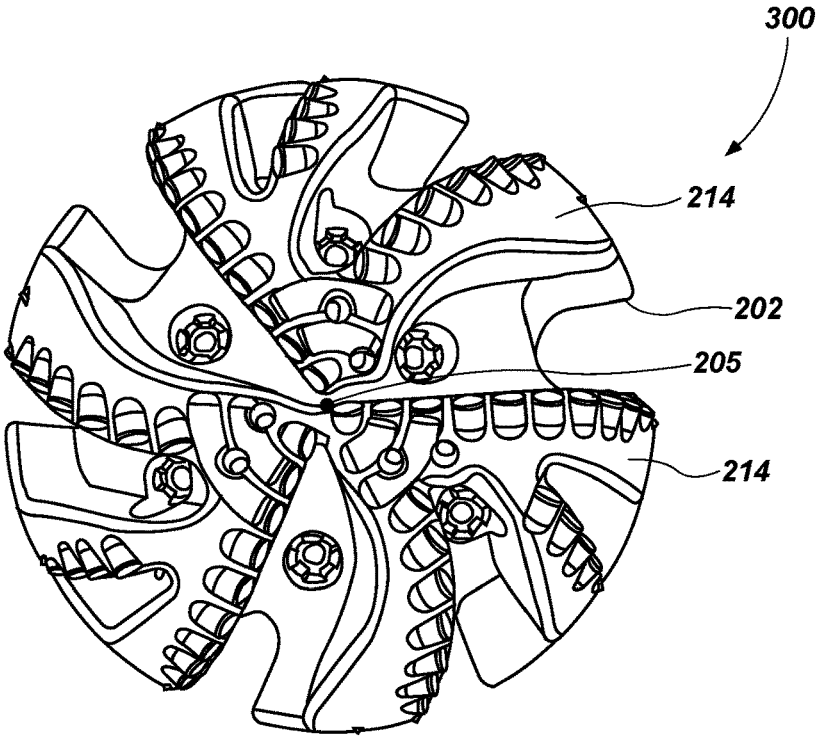
FIG. 3 is a bottom view of the earth-boring tool of FIG. 2.
Figure 4:
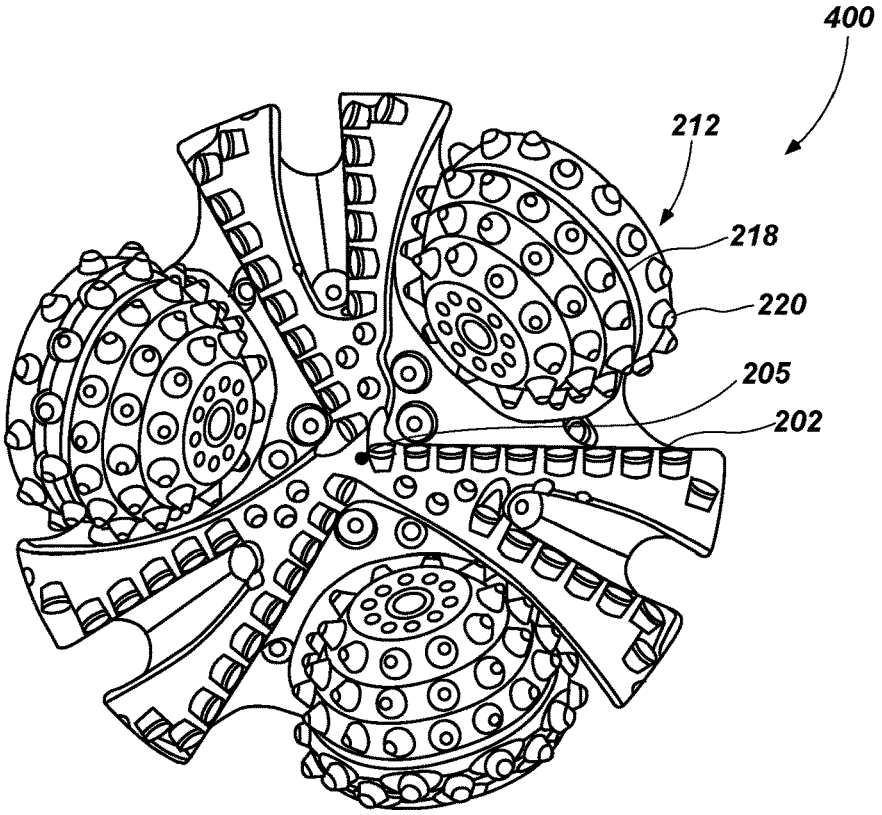
FIG. 4 is a bottom view of another earth-boring tool according to one or more embodiments of the present disclosure.

FIG. 2 is a perspective view of an earth-boring tool 200 that may be used with the drilling assembly 114 of FIG. 1 according to one or more embodiments of the present disclosure. FIG. 3 is a bottom view of another earth-boring tool 300 according to one or more embodiments of the present disclosure. FIG. 4 is a bottom view of another earth-boring tool 400 according to one or more embodiments of the present disclosure. Referring to FIGS. 2-4 together, the earth-boring tools (referred to herein collectively as "earth-boring tool 200") may comprise a body 202 including a neck 206, a shank 208, and a crown 210. In some embodiments, the bulk of the body 202 may be constructed of steel, or of a ceramic-metal composite material including particles of hard material (e.g., tungsten carbide) cemented within a metal matrix material. The body 202 of the earth-boring tool 200 may have an axial center defining a center longitudinal axis 205 that may generally coincide with a rotational axis of the earth-boring tool 200. The center longitudinal axis 205 of the body 202 may extend in a direction hereinafter referred to as an "axial direction."

The body 202 may be connectable to a drill string 110 (FIG. 1). For example, the neck 206 of the body 202 may have a tapered upper end having threads thereon for connecting the earth-boring tool 200 to a box end of a drilling assembly 114 (FIG. 1). The shank 208 may include a lower straight section that is fixedly connected to the crown 210 at a joint. In some embodiments, the crown 210 may include a plurality of rotatable cutting structure assemblies 212 and a plurality of blades 214. For example, the earth-boring tool 200 may be a hybrid bit (e.g., a drill bit having both roller cones and blades) as shown in FIG. 4. In other embodiments, the crown 210 may include a fixed-blade bit as shown in FIGS. 2 and 3.

Each blade 214 of the plurality of blades 214 of the earth-boring tool 200 may include a plurality of cutting elements 230 fixed thereto. The plurality of cutting elements 230 of each blade 214 may be located in a row along a profile of the blade 214 proximate a rotationally leading face 232 of the blade 214. In some embodiments, the plurality of cutting elements 230 of the plurality of blades 214 may include PDC cutting elements. Moreover, the plurality of cutting elements 230 of the plurality of blades 214 may include any suitable cutting element configurations and materials for drilling and/or enlarging boreholes. For example, cutting elements as disclosed and claimed in U.S. Pat. Nos. 5,697,462; 5,706,906; 6,053,263; 6,098,730; 6,571,891; 8,087,478; 8,505,634; 8,684,112; 8,794,356 and 9,371,699, assigned to the Assignee of the present application and hereby incorporated herein in the entirety of each by this reference, may be employed as cutting elements 230.

Additionally, the earth-boring tool 200 may include one or more hybrid ovoids 250 mounted at axial ends of the plurality of blades 214. In some embodiments, the one or more hybrid ovoids 250 may be mounted within the plurality of blades 214 in positions rotationally trailing one or more of the plurality of cutting elements 230. The hybrid ovoids 250 may serve to control an aggressiveness of the earth-boring tool. For example, the hybrid ovoids 250 may control an aggressiveness of the earth-boring tool via any of the manners described in U.S. patent application Ser. No. 15/725,097 to Russell et al., filed Oct. 4, 2017, the disclosure of which is incorporated in its entirety by reference herein. Furthermore, as will be described in greater detail below in regard to FIGS. 5A-9, the hybrid ovoids 250 may help to prevent core outs and may provide depth of cut ("DOC") control.

Fluid courses 234 may be formed between adjacent blades 214 of the plurality of blades 214 and may be provided with drilling fluid by ports located at the end of passages leading from an internal fluid plenum extending through the body 202 from a tubular shank 208 at the upper end of the earth-boring tool 200. Nozzles 238 may be secured within the ports for enhancing direction of fluid flow and controlling flow rate of the drilling fluid. In some embodiments, the fluid courses 234 extend to junk slots extending axially along the longitudinal side of earth-boring tool 200 between blades 214 of the plurality of blades 214.

The plurality of rotatable cutting structure assemblies 212 may include a plurality of legs and the plurality of rotatable cutting structures 218, each respectively mounted to a leg. The plurality of legs may extend from an end of the body 202 opposite the neck 206 and may extend in the axial direction. Each rotatable cutting structure 218 may be rotatably mounted to a respective leg of the body 202. For example, each rotatable cutting structure 218 may be mounted to a respective leg with one or more of a journal bearing and rolling-element bearing. Many such bearing systems are known in the art and may be employed in embodiments of the present disclosure. Additionally, each of the rotatable cutting structure assemblies 212 may include a rotatable cutting structure 218 having a plurality of cutting elements 220 (e.g., teeth or tungsten carbide inserts).

Figure 5A:
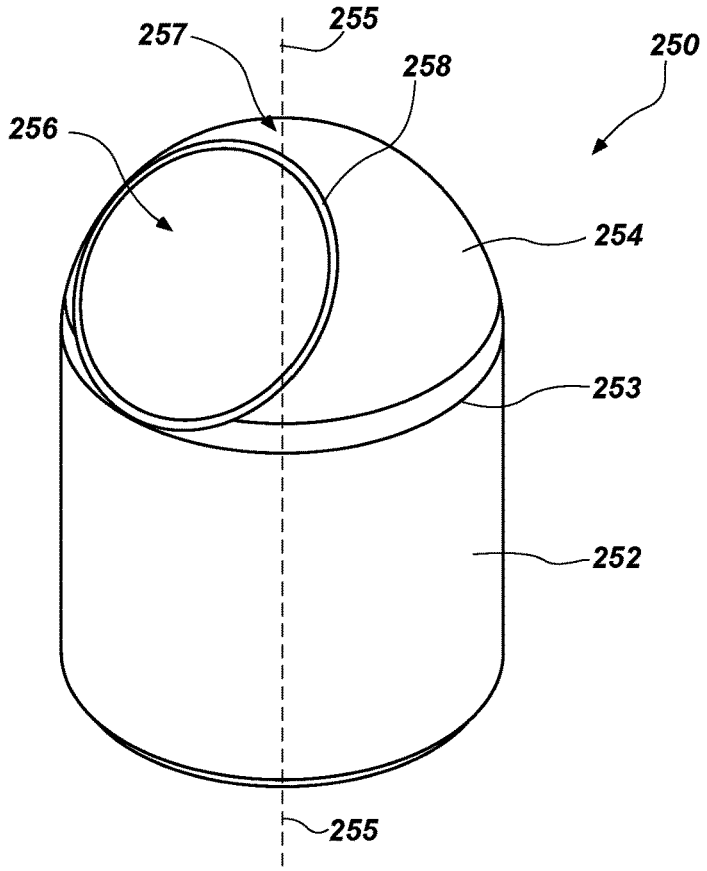
FIG. 5A is a perspective view of a hybrid ovoid according to one or more embodiments of the present disclosure.
Figure 5B:
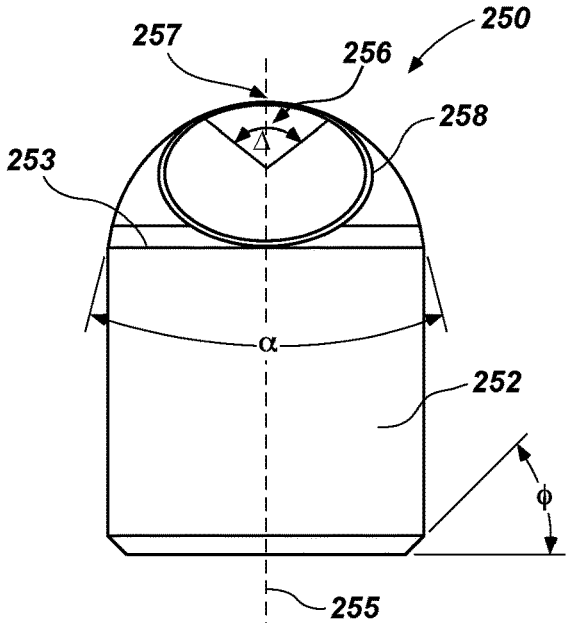
FIG. 5B is a front view of the hybrid ovoid of FIG. 5A.
Figure 5C:
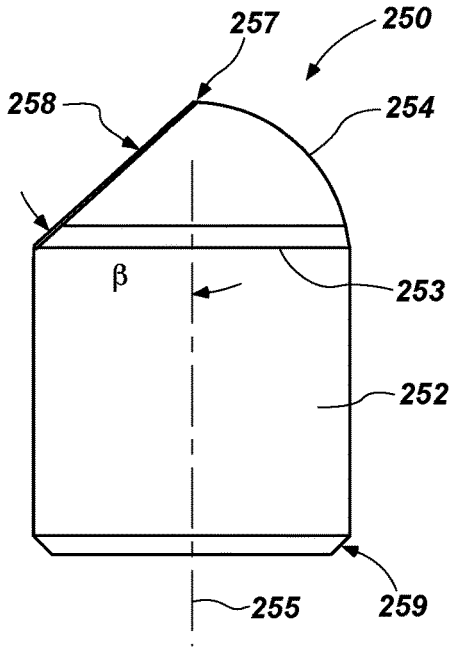
FIG. 5C is a side view of the hybrid ovoid of FIG. 5A.

FIG. 5A shows a perspective view of a hybrid ovoid 250 according to one or more embodiments of the present disclosure. FIG. 5B shows a front view of the hybrid ovoid 250 of FIG. 5A. FIG. 5C shows a side view of the hybrid ovoid 250 of FIG. 5A. Referring to FIGS. 5A-5C together, the hybrid ovoid 250 may include a base portion 252 and an upper portion 254. The upper portion 254 may extend from a top (e.g., a longitudinal end) of the base portion 252 of the hybrid ovoid 250. The upper portion 254 and the base portion 252 may define an interface 253 therebetween.

In some embodiments, the base portion 252 may be at least substantially cylindrical. In other embodiments, the base portion 252 may have an elliptical cylinder shape, a triangular prism shape, a rectangular prism shape, or any other prism shape. Furthermore, in one or more embodiments, the upper portion 254 may include a domed upper portion. For example, the upper portion 254 may have a general dome shape. In other words, the upper portion 254 may have a hemispherical shape. In other embodiments, the upper portion 254 may include a squared based dome or any other shaped dome. In embodiments wherein the upper portion 254 includes a domed upper portion, the domed upper portion may a radius of curvature within a range of about 0.24 inch and about 0.26 inch. As will be appreciated by one of ordinary skill in the art, the radius of curvature may be dependent on a diameter of the base portion 252 of the hybrid ovoid. For instance, the values described herein correspond to a base portion 252 having 0.50 inch diameter. However, other values and diameters are contemplated. For example, the domed upper portion may have a radius of curvature of about 0.250 inch. Additionally, lines tangent to the domed upper portion of the hybrid ovoid 250 at the interface 253 of the upper portion 254 and the base portion 252 of the hybrid ovoid 250 and on opposite sides of the hybrid ovoid 250 may define an acute angle $\sigma$ therebetween. The acute angle $\sigma$ may be within the range of about 15° and about 400. For example, the acute angle $\sigma$ may be about 25°. In some embodiments, the upper portion 254 and/or the base portion 252 may be formed by pressing material into a mold within a diamond press. Furthermore, the upper portion 254 and the base portion 252 of the hybrid ovoid 250 may comprise a single piece. Accordingly, in comparison to conventional cylindrical cutters brazed on posts, the hybrid ovoids 250 of the present disclosure may have higher strengths, be more robust, and have a simpler design. In some embodiments, the upper portion 254 may be formed by pressing a fill dome top and then forming a cutting surface (described below).

Additionally, the hybrid ovoid 250 may include a cutting surface 256 formed in at least the upper portion 254 of the hybrid ovoid 250. For example, the cutting surface 256 may truncate a portion of the upper portion 254 of the hybrid ovoid 250. The cutting surface 256 may be configured for shear-type cutting action during drilling operation. In some embodiments, the cutting surface 256 may define a cutting edge 258 along an outer periphery of the cutting surface 256. In one or more embodiments, the cutting edge 258 may extend angularly (e.g. extend angularly through angle $\Delta$) to define a curvature for at least 1800 and may have a radius within the range of about 0.15 inch to about 0.20 inch. As will be appreciated by one of ordinary skill in the art, the radius of the cutting edge 258 may be dependent on a diameter of the base portion 252 of the hybrid ovoid. For instance, the values described herein correspond to a base portion 252 having 0.50 inch diameter. However, other values and diameters are contemplated. In additional embodiments, the cutting edge 258 may extend angularly through angle $\Delta$ for 360°. For instance, the cutting edge 258 may include an at least substantially circular cutting edge 258. Furthermore, the circular cutting edge 258 may have a diameter within a range of about 0.30 inch and about 0.40 inch. For instance, the circular cutting edge 258 may have a diameter of about 0.342 inch. As will be appreciated by one of ordinary skill in the art, the diameter of the cutting edge 258 may be dependent on a diameter of the base portion 252 of the hybrid ovoid. For instance, the values described herein correspond to a base portion 252 having 0.50 inch diameter. However, other values and diameters are contemplated. In other embodiments, the cutting surface 256 define an elliptical-shaped cutting edge. In further embodiments, the cutting surface 256 may define an irregular-shaped cutting edge (e.g., a double-truncated circular shape, two connected differing arcuate edges, etc.). In some embodiments, the cutting surface 256 and cutting edge 258 may be formed by cutting off a portion of the upper portion 254 of the hybrid ovoid 250 using a laser, electrical discharge machining, grinding, etc.

In some embodiments, the base portion 252 (e.g., the substrate) may comprise a cemented carbide (e.g., tungsten carbide). Additionally, the upper portion 254, cutting surface 256, and cutting edge 258 may comprise a superabrasive material such as, for example, polycrystalline diamond, a cubic boron nitride compact, or diamond-like carbon (DLC). In additional embodiments, the upper portion 254, cutting surface 256, and cutting edge 258 may comprise the same material as the base portion 252 and may be integral therewith, or may comprise a superabrasive layer over material of the substrate, as disclosed in U.S. Pat. No. 9,316,058, assigned to the Assignee of the present invention and the disclosure of which is incorporated herein in its entirety by this reference. The superabrasive layer may comprise, for example, polycrystalline diamond, a cubic boron nitride compact, a chemical vapor deposition (CVD) applied diamond film, or diamond-like carbon (DLC).

In some embodiments, the cutting surface 256 may be at least substantially planar. In other embodiments, the cutting surface 256 may be concave or convex. In alternative embodiments, the cutting surface 256 may have a ribbed surface, a sinusoidal surface, axisymmetric sinusoidal surface, periodic sinusoidal surface, or any combination thereof.

In one or more embodiments, the cutting surface 256 and the cutting edge 258 may intersect the interface 253 of the upper portion 254 and the base portion 252. For example, the cutting edge 258 of the cutting surface 256 may meet the interface 253 of the upper portion 254 and the base portion 252 of the hybrid ovoid 250. In some embodiments, the cutting surface 256 may extend from the interface 253 and may define an acute angle (j with a center longitudinal axis 255 of the hybrid ovoid 250. For example, the cutting surface 256 may define an acute angle β within a range of about 30° and about 60° with the center longitudinal axis 255 of the hybrid ovoid 250. For example, the cutting surface 256 may define an acute angle β of about 48° with the center longitudinal axis 255 of the hybrid ovoid 250.

In some embodiments, the cutting surface 256 may extend from the interface 253 of the upper portion 254 and the base portion 252 of hybrid ovoid 250 to an apex 257 of the upper portion 254 (e.g., an apex 257 of a dome of the upper portion 254) of the hybrid ovoid 250. By having the cutting surface 256 extend from the interface 253 of the upper portion 254 and the base portion 252 and to the apex 257 of the upper portion 254 of the hybrid ovoid 250, the hybrid ovoid 250 may maintain maximum DOC control capabilities while maximizing a cutting ability of the hybrid ovoid 250 for a given height of the upper portion 254 of the hybrid ovoid 250. Furthermore, having the cutting surface 256 extend from the apex 257 of the upper portion 254 of the hybrid ovoid 250 may cause crushing loads on the hybrid ovoid 250 to be primarily sustained by the rounded surface of the upper portion 254 (e.g., the hemispherical portion or domed portion) of the hybrid ovoid 250. In alternative embodiments, the cutting surface 256 can be offset from the apex 257 of the upper portion 254, as is described in greater detail in regard to FIGS. 7 and 8.

As will be appreciated by one of ordinary skill in the art, the upper portion (e.g., a domed upper portion) of the hybrid ovoid 250 may provide a backing (e.g., a trailing face) to the cutting surface 256 of the hybrid ovoid 250 and may improve durability of cutting surface 256 and cutting abilities of the hybrid ovoid 250. For example, in some embodiments, the upper portion 254 may provide a partial hemispherical-shaped backing to the cutting surface 256 of the hybrid ovoid 250. Additionally, as is described in greater detail in regard to FIG. 9, the cutting surface 256 of the hybrid ovoid 250 may make the hybrid ovoid 250 more efficient (e.g., more efficient at controlling DOC) at low depths of cut and more responsive (e.g., more responsive at controlling DOC) at high depths of cut in comparison to conventional round ovoids.

In some embodiments, a height of the upper portion 254 (e.g., a height of a dome of the upper portion 254) of the hybrid ovoid 250 may be dependent on the angle β defined between the cutting surface 256 and the center longitudinal axis 255 of the hybrid ovoid 250 or vice versa. In some embodiments, the upper portion 254 may have a height within a range of about 0.10 inch and about 0.40 inch. For example, the upper portion 254 may have a height of about 0.232 inch.

In embodiments having a cylindrical base portion, the base portion 252 may have a diameter within a range of about 0.35 inch to about 0.75 inch. For example, the base portion 252 may have a diameter of about 0.504 inch. Furthermore, the base portion 252 may have a height within a range of about 0.25 inch and about 0.75 inch. For example, the base portion 252 may have a height of about 0.49 inch. Additionally, the hybrid ovoid 250 may have an overall height within a range of about 0.5 inch and about 1.0 inch. For example, the hybrid ovoid 250 may have an overall height of about 0.722 inch.

In one or more embodiments, the hybrid ovoid 250 may include a frustoconical surface 259 (e.g., a tapered end) at a base of the base portion 252. The frustoconical surface 259 may define an acute angle 4 with a horizontal plane (e.g., plane parallel within a bottom surface of the base portion 252 of the hybrid ovoid 250) within a range of about 48° and about 42°. For example, the acute angle ϕ may be about 45°.

Referring to FIGS. 2 and 5A-5C together, in some embodiments the hybrid ovoid 250 may be located in cone and nose regions of the plurality of blades 214. Furthermore, the hybrid ovoids 250 may rotationally lead or trail cutting elements 230 in the cone and nose regions of the plurality of blades 214. As shown, the hybrid ovoids 250 may lie at similar radial positions as the cutting elements 230, which hybrid ovoids 250 respectively lead. In some embodiments, the hybrid ovoids 250 may be partially radially offset from an associated cutting element 230, which hybrid ovoids 250 respectively lead. Additionally, the hybrid ovoids 250 may lie substantially radially between two respectively led cutting elements 230 to encounter and break formation rock tips between the cutting elements 230 on the profile. In some instances, the hybrid ovoids 250 may be laterally adjacent and between cutting elements 230. With various radial placements, the hybrid ovoids 250 may, in some instances rotationally trail cutting elements 230 mounted to a shared blade.

Furthermore, as will be appreciated by one of ordinary skill in the art, because the hybrid ovoids 250 are axially mounted to the blades 214 of the earth-boring tool (e.g., mounted in apertures having center longitudinal axes 255 parallel to the center longitudinal axis 205 of the earth-boring tool), the hybrid ovoids 250 may be mounted in tighter (e.g., more congested) areas of the earth-boring tool 200 in comparison to conventional cutting elements. For instance, because the hybrid ovoids 250 are axially mounted, the hybrid ovoids 250 may be mounted proximate to the center longitudinal axis 205 of the earth-boring tool 200. Furthermore, because the hybrid ovoids 250 are axially mounted, the hybrid ovoids 250 may enable a higher exposure of the cutting surfaces 256 of the hybrid ovoids 250 over the bit body. For example, the hybrid ovoids 250 may have any of the exposures described in U.S. patent application Ser. No. 15/725,097 to Russell et al., filed Oct. 4, 2017, the disclosure of which is incorporated in its entirety by reference herein. In view of the foregoing, because the hybrid ovoids 250 may be mounted in tighter (e.g., more congested) areas (e.g., areas more proximate the center longitudinal axis) of the earth-boring tool 200, the hybrid ovoids 250 may provide core out protection.

Referring still to FIGS. 2 and 5A-5C together, the hybrid ovoids 250 may be purposefully structured to exhibit an inefficient cutting action, so as to require a substantial WOB increase when earth-boring tool or drag bit 200 takes a relatively deep DOC, while decreasing TOB relative to a bit without DOCC. The cutting surface 256 of the hybrid ovoid 250 may be back raked more than a back rake of a cutting face of an associated cutting element 230. For instance, the cutting surfaces of the hybrid ovoids may have a back rake within a range of about 250 to about 60°. Additionally, the cutting surfaces of the hybrid ovoids may have a side rake within a range of about −15° to about 15°. In alternative embodiments, the cutting surfaces of the hybrid ovoids may have a back rake that is the same as or less than the back rake of an associated cutting element 230.

Figure 6:
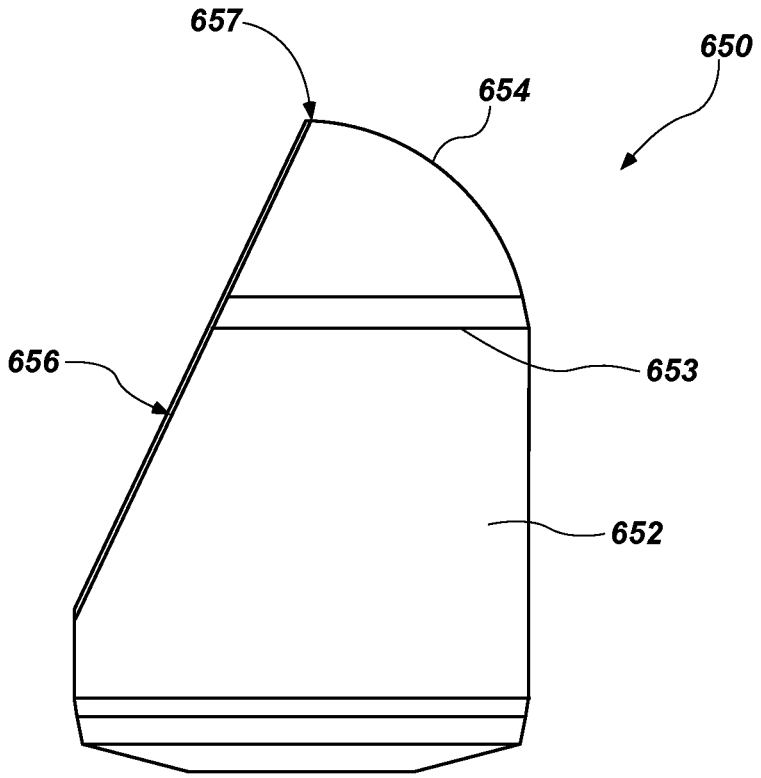
FIG. 6 is a side view of another hybrid ovoid accordingly to one or more embodiments of the present disclosure.

FIG. 6 shows a side view of a hybrid ovoid 650 according to another embodiment of the present disclosure. The hybrid ovoid 650 may include an upper portion 654 and a base portion 652 similar to the hybrid ovoid 250 described above in regard to FIGS. 5A-5C. However, the hybrid ovoid 650 may include a cutting surface 656 that extends beyond an interface 653 between the base portion 652 and upper portion 654 of the hybrid ovoid 650 and into the base portion 652. For example, the cutting surface 656 may extend from an apex 657 of the upper portion 654 (i.e., the domed upper portion) and may extend to a mid-portion of the base portion 652 of the hybrid ovoid 250. In other words, the cutting surface 656 may extend from an apex 657 of the upper portion 654 (i.e., the domed upper portion) and may extend to a portion of the base portion 652 below the interface 653 between the upper portion 654 and the base portion 652 of the hybrid ovoid 650. The embodiment described in regard to FIG. 6 may increase an aggressiveness of the cutting surface 656 for a given cylinder diameter (decrease back rake), while maintaining a start of the cutting surface 656 near the apex 657 of the hybrid ovoid 650 so that the hybrid ovoid 650 efficiently engages a formation.

Figure 7:
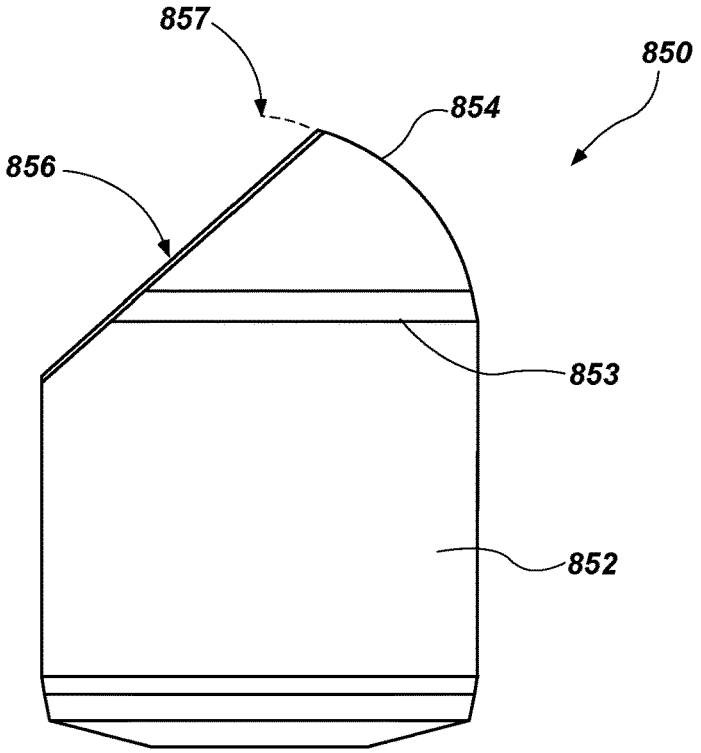
FIG. 7 is a side view of another hybrid ovoid accordingly to one or more embodiments of the present disclosure.

FIG. 7 shows a side view of a hybrid ovoid 850 according to another embodiment of the present disclosure. The hybrid ovoid 850 may include an upper portion 854 and a base portion 852 similar to the hybrid ovoid 250 described above in regard to FIGS. 5A-5C. However, the hybrid ovoid 850 may include a cutting surface 856 that extends from a location offset from apex 857 of the upper portion 854 and to a location beyond the interface 853 (e.g., past the interface 853) between the upper portion 854 and the base portion 852 of the hybrid ovoid 850. For instance, the cutting surface 856 may extend from a location that is offset from the apex 857 of the upper portion 854 by a linear distance with a range of about −0.10 inch and about 0.10 inch.

Figure 8:
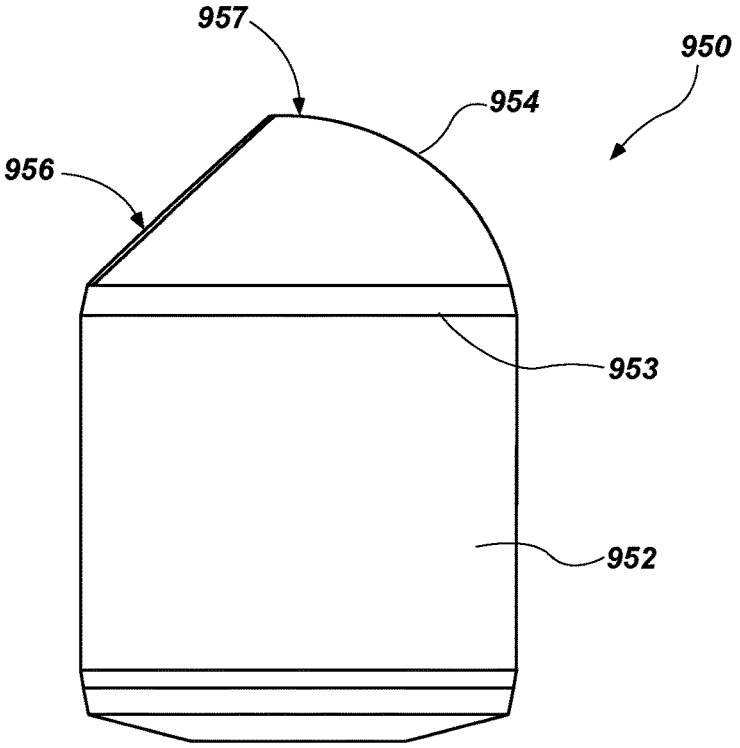
FIG. 8 is a side view of another hybrid ovoid accordingly to one or more embodiments of the present disclosure.

FIG. 8 is a side view of a hybrid ovoid 950 according to another embodiment of the present disclosure. The hybrid ovoid 950 may include an upper portion 954 and a base portion 952 similar to the hybrid ovoid 250 described above in regard to FIGS. 5A-5C. However, the hybrid ovoid 950 may include a cutting surface 956 that extends from a location offset from apex 957 of the upper portion 954 and to location above the interface 953 between the upper portion 954 and the base portion 952 of the hybrid ovoid 950. The embodiment described in regard to FIG. 8 increases a durability of the upper portion 954 of the hybrid ovoid 950 by increasing resistance to axial impact loads with the domed upper portion 954. Additionally, the embodiments described in regard to FIG. 8 provide a different aggressiveness than some embodiments described herein.

Figure 9:
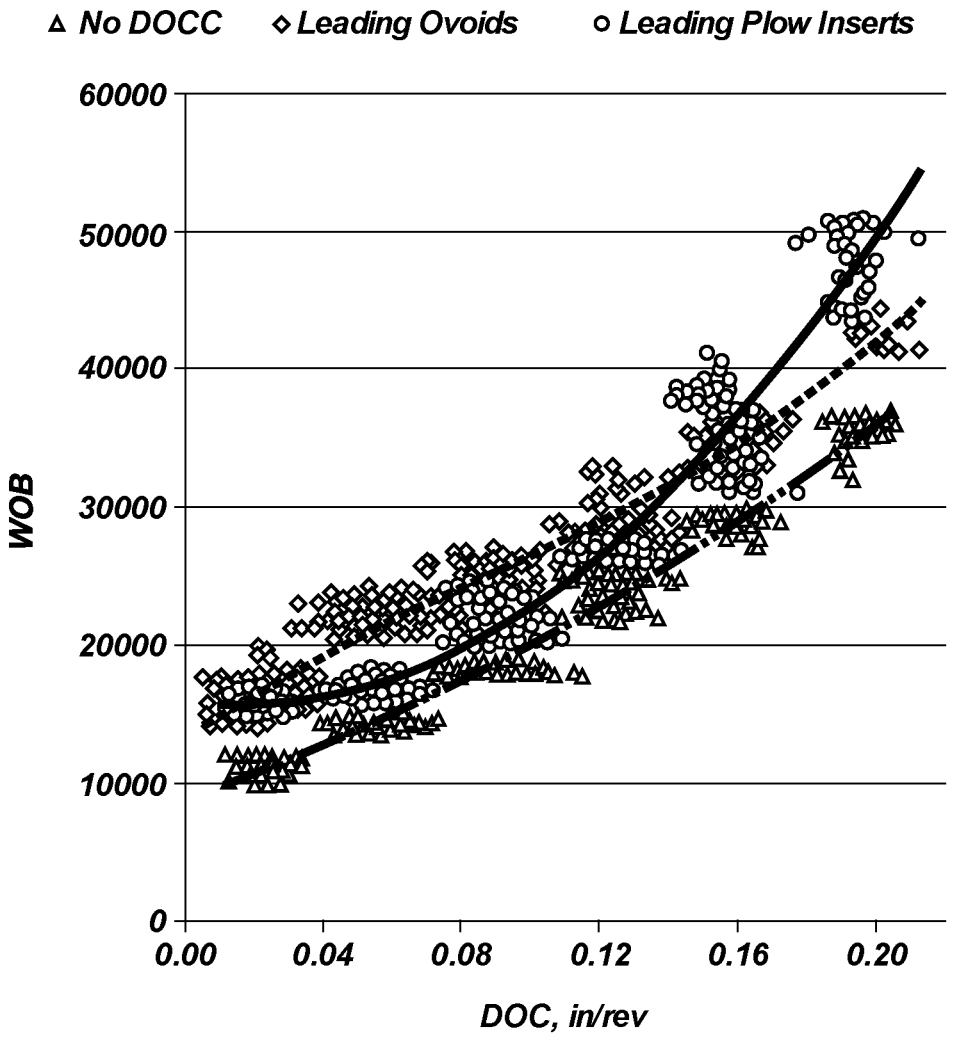
FIG. 9 is a graph showing a comparison of depth-of-cut and weight-on-bit for various earth-boring tools.

FIG. 9 shows a graph illustrating DOC and WOB for an earth-boring tool having no DOC control elements, an earth-boring tool having conventional ovoids as DOC control elements, and an earth-boring tool having the hybrid ovoids 250 as described herein. As shown in the graph, for an earth-boring tool having the hybrid ovoids 250 described herein, after increasing a DOC of the earth-boring beyond a certain amount, significantly more WOB is required to achieve higher DOC in comparison to conventional earth-boring. Accordingly, at relatively high levels of DOC, the hybrid ovoids 250 of the present disclosure may be more responsive (at controlling DOC) in comparison to conventional DOC control elements. Furthermore, as shown in the graph, for an earth-boring tool having the hybrid ovoids 250 described herein, at relatively low depths of cut, relatively small amounts of WOB are required to increase the DOC of the earth-boring tool. As a result, at relatively low depths of cut, hybrid ovoids 250 of the present disclosure may be more efficient as a DOC control in comparison to conventional DOC control elements. The graph in FIG. 9 originates from an 8.5 inch Baker Hughes 406 drag bit with three rotationally leading hybrid ovoids at 3,000 psi pressure in Mancos shale rotated at 90 rpm with ROP control.

Example 1

Figure 10:
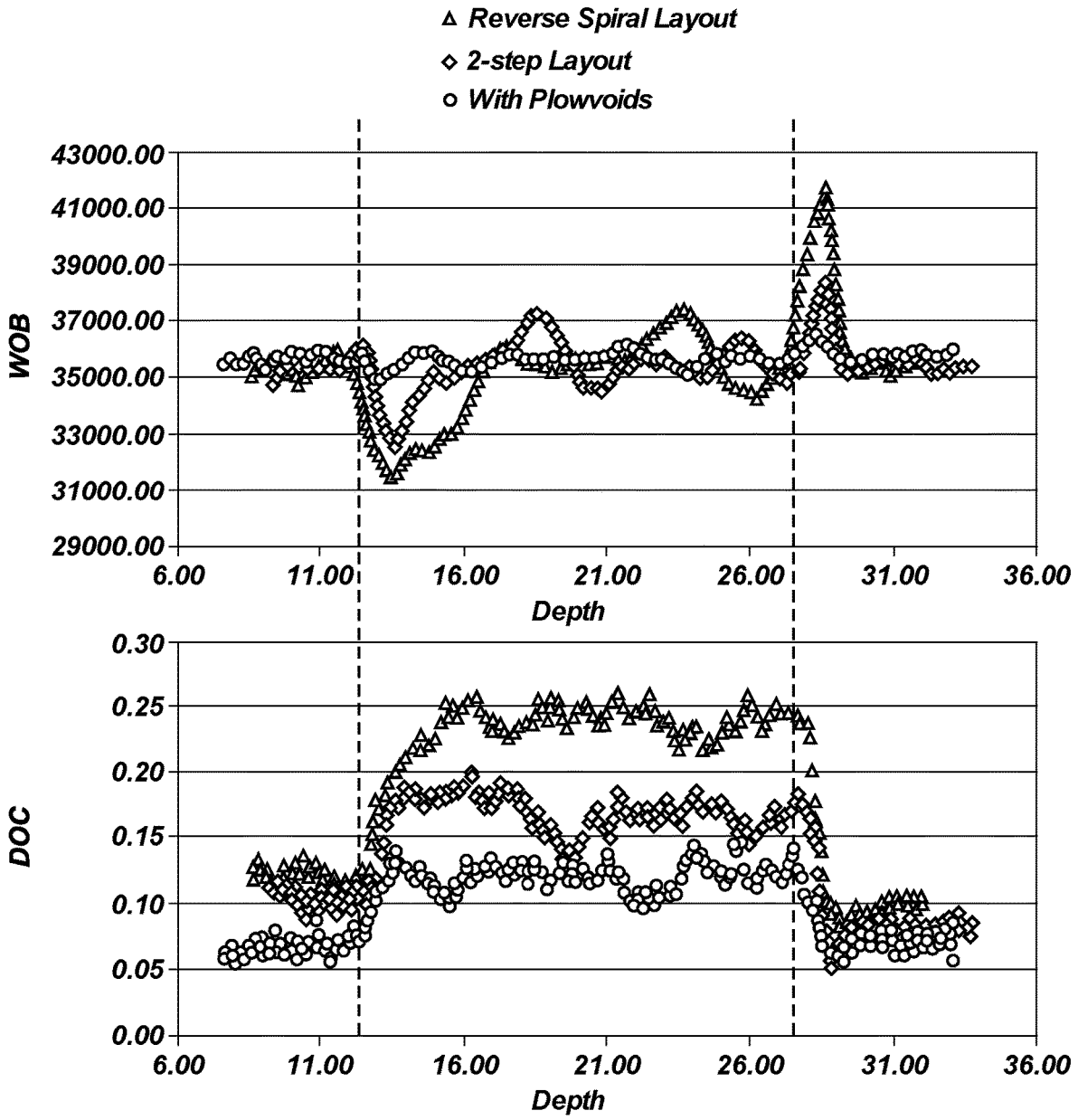
FIG. 10 is a chart showing a comparison of earth-boring tools having hybrid ovoids of the present disclosure and conventional earth-boring tools.
Figure 11A:
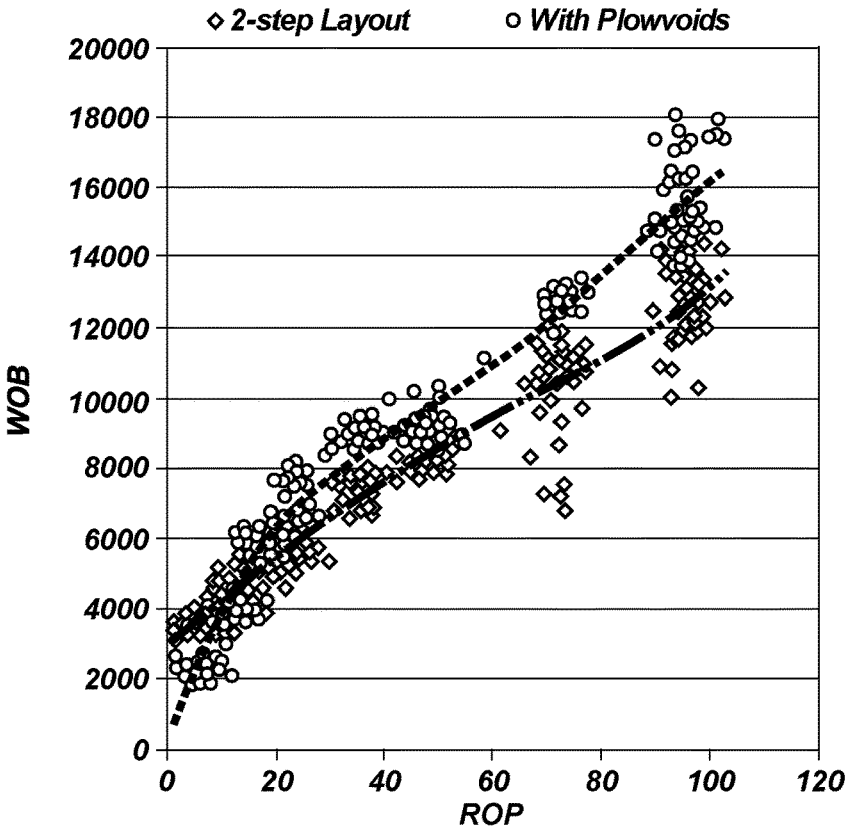
FIGS. 11A-11D are charts showing comparisons of earth-boring tools having hybrid ovoids of the present disclosure and conventional earth-boring tools.
Figure 11B:
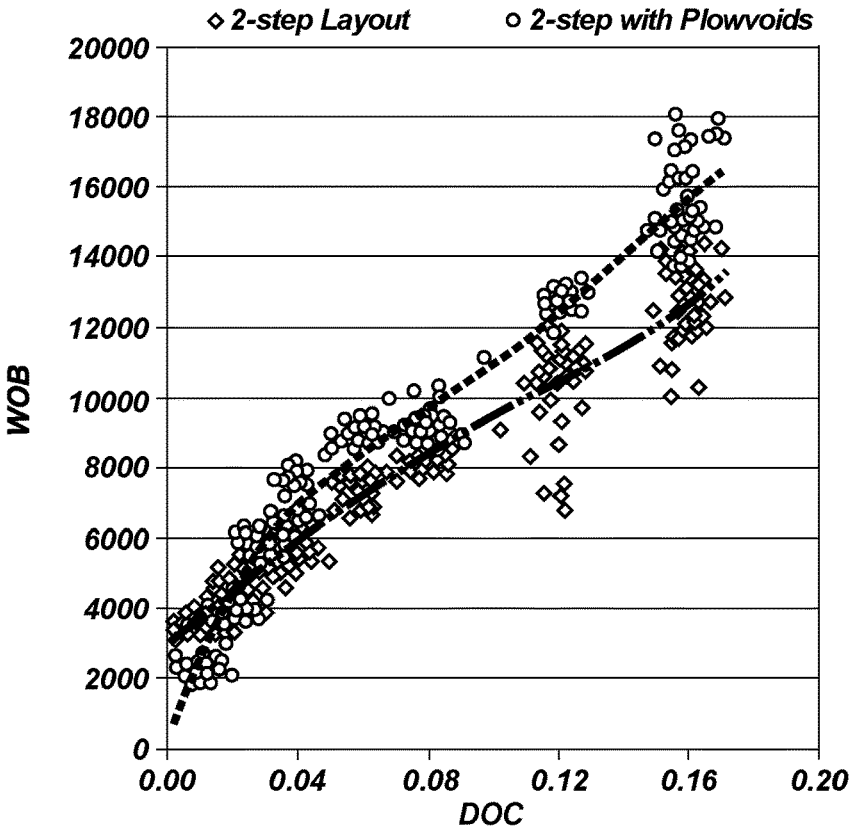
Figure 11C:
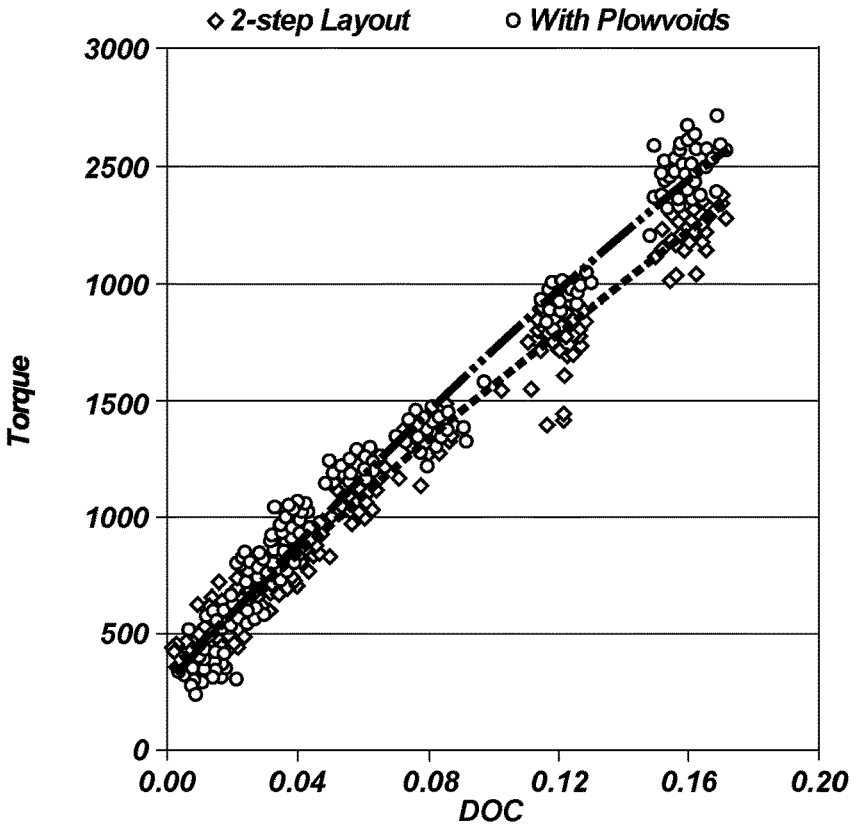
Figure 11D:
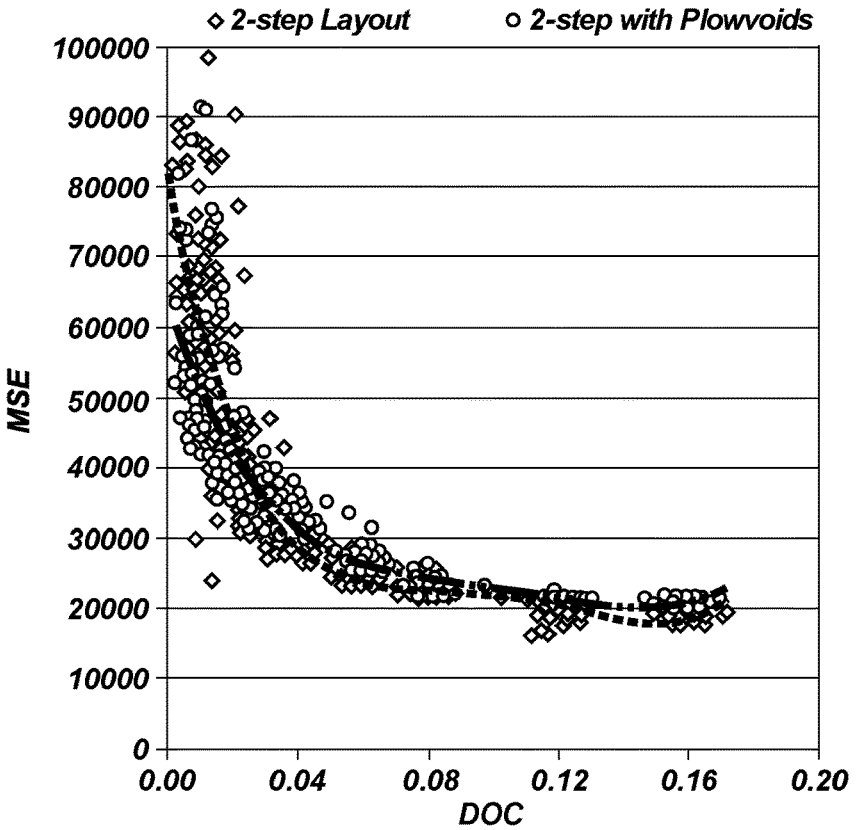

In laboratory tests, an 8.5 inch Baker Hughes 506 drag bit was run in an ROP control simulator laboratory test in Mancos shale and Alabama limestone at 3,000 psi pressure and rotated at 90 rpm. WOB was set at about 35,000 lb. In three (3) different tests, the bit was respectively 1) run with a conventional layout and no DOCC structures, 2) run with an unconventional layout (type of bit shown in FIG. 2) and no DOCC structures, and 3) run with the unconventional layout and six hybrid ovoids (bit shown in FIG. 2) trailing traditional cutting elements within three blades (e.g., 6 leading at 0.030 inch under). As shown in FIG. 10, the earth-boring tool with the hybrid ovoids did not experience a WOB fluctuations across transition from Mancos shale to Alabama limestone and from Alabama limestone to Mancos shale. As a result, the earth-boring tool may exhibit greater controllability and cutter overload protection in comparison to conventional earth-boring tools. Additionally, the earth-boring tool with the hybrid ovoids experienced a smaller DOC range across the transition. Accordingly, the earth-boring tool may provide improved durability when drilling interbedded formations in comparison to conventional earth-boring tools.

Example 2

In laboratory tests, an 8.5 inch Baker Hughes 506 drag bit was run in an ROP control simulator laboratory test in Alabama limestone at atmospheric pressure and rotated at 120 rpm. WOB was increased from about 1,000 lb to about 20,000 lb. In three (2) different tests, the bit was respectively 1) run with an unconventional layout (type of bit shown in FIG. 2) and no DOCC structures and 2) run with the unconventional layout and six hybrid ovoids (bit shown in FIG. 2) trailing traditional cutting elements within three blades (e.g., 6 leading at 0.030 inch under). As shown in FIGS. 11A-11D, the earth-boring tool with the hybrid ovoids drilled (i.e., performed) efficiently at low DOC. However, the earth-boring tool required significantly more weight to increase ROP at high DOC in comparison to conventional earth-boring tools. As a result, the earth-boring tool may exhibit greater controllability in directional drilling in engineered (e.g., chosen) DOC in comparison to conventional earth-boring tools.

The present disclosure further includes the following embodiments.

Embodiments 1

An earth-boring tool, comprising: a body having at least one blade extending axially from the body; at least one cutting element mounted at a leading face of the at least one blade; and at least one hybrid ovoid mounted at an axial end of the at least one blade and rotationally trailing the at least one cutting element, the at least one hybrid ovoid comprising: a cylindrical base portion; a domed upper portion extending from a top of the cylindrical base portion; and an at least substantially planar cutting surface formed in at least the domed upper portion and defining a cutting edge extending angularly through an angle of at least 1800, the at least substantially planar cutting surface configured for a shear-type cutting action, oriented substantially in the direction of intended bit rotation, and exhibiting a lesser aggressiveness than the aggressiveness of the at least one cutting element.

Embodiment 2

The earth-boring tool of embodiment 1, wherein an arcuate surface of domed upper portion has a radius of curvature within a range of about 0.24 inch and about 0.26 inch.

Embodiment 3

The earth-boring tool of embodiments 1 or 2, wherein cutting edge comprises an at least substantially circular cutting edge.

Embodiment 4

The earth-boring tool of embodiment 3, wherein the cutting surface has a diameter within a range of about 0.30 inch and about 0.40 inch.

Embodiment 5

The earth-boring tool of any of embodiments 1-4, wherein the cutting surface extends from an interface of the base portion and the domed upper portion to proximate an apex of the domed upper portion.

Embodiment 6

The earth-boring tool of any of embodiments 1-5, wherein a center longitudinal axis of the at least one hybrid ovoid is parallel to a center longitudinal axis of the earth-boring tool.

Embodiment 7

The earth-boring tool of any of embodiments 1-6, wherein the at least one hybrid ovoid is disposed within a cone region of the at least one blade.

Embodiment 8

The earth-boring tool of any of embodiments 1-7, wherein the cutting surface of the hybrid ovoid is oriented at an angle relative to a center longitudinal axis of the hybrid ovoid within a range of about 30° and about 60°.

Embodiment 9

The earth-boring tool of any of embodiments 1-7, wherein the cutting surface of the hybrid ovoid has a back rake within a range of about 25° and about 60° and a side rake within a range of about −15° and about 150.

Embodiment 10

The earth-boring tool of any of embodiments 1-9, wherein a height of exposure of the cutting element and a height of exposure of the hybrid ovoid are substantially the same or slightly underexposed.

Embodiment 11

A hybrid ovoid comprising: a cylindrical base portion; a domed upper portion extending from a top of the cylindrical base portion; and an at least substantially planar cutting surface formed in the domed upper portion and defining a cutting edge extending angularly through an angle of at least 180°, the at least substantially planar surface configured for a shear-type cutting action, oriented substantially in the direction of intend bit rotation, and exhibiting a lesser aggressiveness than the aggressiveness of the at least one cutting element.

Embodiment 12

The earth-boring tool of embodiment 11, wherein an arcuate surface of domed upper portion has a radius of curvature within a range of about 0.24 inch to about 0.26 inch.

Embodiment 13

The earth-boring tool of embodiments 11 or 12, wherein the base portion comprises a cemented carbide, and wherein the upper portion comprises a superabrasive material.

Embodiment 14

The earth-boring tool of any of embodiments 11-13, wherein the cutting surface has an at least substantially circular peripheral edge.

Embodiment 15

The earth-boring tool of any of embodiments 11-14, wherein the cutting surface extends from a region of the cylindrical base portion below an interface of the base portion and the upper portion and to an apex of the upper portion of the hybrid ovoid.

Embodiment 15

The earth-boring tool of any of embodiments 11-16, wherein the cutting surface extends from an interface of the base portion and the upper portion to an apex of the upper portion.

Embodiment 16

The earth-boring tool of any of embodiments 11-17, wherein a height of the domed upper portion is dependent on a diameter of the cutting surface.

Embodiment 17

A method of forming an earth-boring tool, the method comprising: forming a hybrid ovoid comprising: forming a domed upper portion on a cylindrical base portion of a hybrid ovoid; forming a cutting surface in at least the upper portion of the hybrid ovoid; forming the cutting surface to extend angularly through an angle of at least 180°; and mounting the hybrid ovoid to an axial end of a blade of an earth-boring tool such a center longitudinal axis of the hybrid ovoid is substantially parallel to a center longitudinal axis of the earth-boring tool.

Embodiment 18

The earth-boring tool of embodiment 17, wherein forming the upper portion comprises pressing the upper portion within a mold.

Embodiment 19

The earth-boring tool of embodiments 17 or 18, wherein forming the cutting surface comprises defining the cutting surface with a laser.

Embodiment 20

The earth-boring tool of any of embodiments 17-19, wherein forming the cutting surface comprises forming an at least substantially circular cutting surface.

While certain illustrative embodiments have been described in connection with the figures, those of ordinary skill in the art will recognize and appreciate that embodiments encompassed by the disclosure are not limited to those embodiments explicitly shown and described herein. Rather, many additions, deletions, and modifications to the embodiments described herein may be made without departing from the scope of embodiments encompassed by the disclosure, such as those hereinafter claimed, including legal equivalents. In addition, features from one disclosed embodiment may be combined with features of another disclosed embodiment while still being encompassed within the scope of the disclosure.

What is claimed is:

1. An earth-boring tool, comprising:

a body having at least one blade extending axially from the body;

at least one cutting element mounted at a leading face of the at least one blade; and at least one hybrid ovoid mounted at an axial end of the at least one blade and rotationally trailing the at least one cutting element, the at least one hybrid ovoid comprising:

a cylindrical base portion;

a domed upper portion extending from a top of the cylindrical base portion; and an at least substantially planar cutting surface formed in at least the domed upper portion and defining a cutting edge extending angularly through an angle of at least 180°, the at least substantially planar cutting surface configured for a shear-type cutting action, oriented substantially in a direction of intended bit rotation, and exhibiting a lesser aggressiveness than an aggressiveness of the at least one cutting element, the at least substantially planar cutting surface extending from approximately an apex of the domed upper portion to at least an interface of the cylindrical base portion and the domed upper portion.

2. The earth-boring tool of claim 1, wherein an arcuate surface of domed upper portion has a radius of curvature within a range of about 0.24 inch and about 0.26 inch.

3. The earth-boring tool of claim 1, wherein cutting edge comprises an at least substantially circular cutting edge.

4. The earth-boring tool of claim 3, wherein the at least substantially planar cutting surface has a diameter within a range of about 0.30 inch and about 0.40 inch.

5. The earth-boring tool of claim 1, wherein the at least substantially planar cutting surface extends from approximately the apex of the domed upper portion to the interface of the cylindrical base portion and the domed upper portion.

6. The earth-boring tool of claim 1, wherein a center longitudinal axis of the at least one hybrid ovoid is substantially parallel to a center longitudinal axis of the earth-boring tool.

7. The earth-boring tool of claim 1, wherein the at least one hybrid ovoid is disposed within a cone region of the at least one blade.

8. The earth-boring tool of claim 1, wherein the at least substantially planar cutting surface of the at least one hybrid ovoid is oriented at an angle relative to a center longitudinal axis of the at least one hybrid ovoid within a range of about 30° and about 60°.

9. The earth-boring tool of claim 1, wherein the at least substantially planar cutting surface of the at least one hybrid ovoid has a back rake within a range of about 25° and about 60° and a side rake within a range of about −15° and about 15°.

10. The earth-boring tool of claim 1, wherein a height of exposure of the at least one cutting element and a height of exposure of the at least one hybrid ovoid are substantially the same.

11. A hybrid ovoid comprising:

a cylindrical base portion;

a domed upper portion extending from a top of the cylindrical base portion; and an at least substantially planar cutting surface formed in the domed upper portion and defining a cutting edge extending angularly through an angle of at least 180°, the at least substantially planar cutting surface configured for a shear-type cutting action, oriented substantially in a direction of intend bit rotation, and exhibiting a lesser aggressiveness than an aggressiveness of the at least one cutting element, the at least substantially planar cutting surface extending from approximately an apex of the domed upper portion to at least an interface of the cylindrical base portion and the domed upper portion.

12. The hybrid ovoid of claim 11, wherein an arcuate surface of domed upper portion has a radius of curvature within a range of about 0.24 inch to about 0.26 inch.

13. The hybrid ovoid of claim 11, wherein the cylindrical base portion comprises a cemented carbide, and wherein the domed upper portion comprises a superabrasive material.

14. The hybrid ovoid of claim 11, wherein the at least substantially planar cutting surface has an at least substantially circular peripheral edge.

15. The hybrid ovoid of claim 11, wherein the at least substantially planar cutting surface extends from a region of the cylindrical base portion below the interface of the cylindrical base portion and the domed upper portion and to approximately the apex of the domed upper portion of the hybrid ovoid.

16. The hybrid ovoid of claim 11, wherein the at least substantially planar cutting surface extends from approximately the apex of the domed upper portion to the interface of the cylindrical base portion and the domed upper portion.

17. The hybrid ovoid of claim 11, wherein a height of the domed upper portion is dependent on a diameter of the at least substantially planar cutting surface.

18. A method of forming an earth-boring tool, the method comprising:

forming a hybrid ovoid comprising:

forming a domed upper portion on a cylindrical base portion of a hybrid ovoid;

forming a cutting surface in at least the domed upper portion of the hybrid ovoid;

forming the cutting surface to extend angularly through an angle of at least 180° and to extend from approximately an apex of the domed upper portion to at least an interface of the cylindrical base portion and the domed upper portion; and mounting the hybrid ovoid to an axial end of a blade of an earth-boring tool such a center longitudinal axis of the hybrid ovoid is substantially parallel to a center longitudinal axis of the earth-boring tool.

19. The method of forming an earth-boring tool of claim 18, wherein forming the domed upper portion comprises pressing the domed upper portion within a mold.

20. The method of forming an earth-boring tool of claim 18, wherein forming the cutting surface comprises defining the cutting surface with a laser.

21. The method of forming an earth-boring tool of claim 18, wherein forming the cutting surface comprises forming an at least substantially circular cutting surface.

* * * * *